United States Patent [19]

Mikulan

[11] Patent Number: 4,648,813

[45] Date of Patent: Mar. 10, 1987

[54] UNIVERSALLY-MOVABLE MACHINE PART AND FLUID TRANSFER APPARATUS UTILIZING SAME

[76] Inventor: Willy E. Mikulan, Res. Concord III, Apt. 52, Calle Las Margaritas, Urb. Las Flores, Santa Teresa Del Tuy, Edo.Miranda, Venezuela

[21] Appl. No.: 728,921

[22] Filed: Apr. 30, 1985

[30] Foreign Application Priority Data

Apr. 30, 1984 [VE] Venezuela ..... 000685

[51] Int. Cl.[4] ..... F01C 0/63

[52] U.S. Cl. ..... 418/49; 418/52; 418/193

[58] Field of Search ..... 418/192, 193, 28, 49–53, 418/68

[56] References Cited

U.S. PATENT DOCUMENTS

| | | | |
|---|---|---|---|
| 2,101,428 | 12/1937 | Cuny | 418/193 |
| 2,292,631 | 8/1942 | Granberg | 418/193 |
| 3,176,908 | 4/1965 | Bowdish | 418/193 |

FOREIGN PATENT DOCUMENTS

| | | | |
|---|---|---|---|
| 251525 | 11/1910 | Fed. Rep. of Germany | 418/53 |
| 672591 | 5/1952 | United Kingdom | 418/28 |
| 97708 | 8/1974 | U.S.S.R. | 418/68 |

*Primary Examiner*—Carlton R. Croyle

*Assistant Examiner*—Jane E. Obee

*Attorney, Agent, or Firm*—Cushman, Darby & Cushman

[57] ABSTRACT

A universally-movable machine part includes a disc member having a disc shaft and a recessed slot defining a bearing surface conforming to a smooth cylindrically-curved plane. At least one planar vane member defines a lower bearing surface conforming to the smooth cylindrically-curved plane of the disc slot so as to be pivotally slidably mated therewith. A rotor member having a rotor shaft defines a groove which establishes a plane passing through a geometric center point of the device and in which an upper portion of the vane member is accepted so as to be pivotal within the established plane. The rotor member also defines a lower surface upwardly and outwardly divergent relative to the geometric center point of the device to permit the rotor member to be pivotally movable about an axis mutually perpendicular with the axis defined by the disc shaft and the axis about which the vane member pivots so that the rotor member will also be pivotally movable together with the vane member. A ball bearing having a diameter larger than the cross-sectional width of the vane member is also provided so as to establish a spherical bearing surface. Accordingly, the rotor shaft is universally movable relative to the disc shaft. A fluid transfer apparatus such as, for example, a fluid pump, utilizing the universally-movable machine part is also disclosed.

18 Claims, 5 Drawing Figures

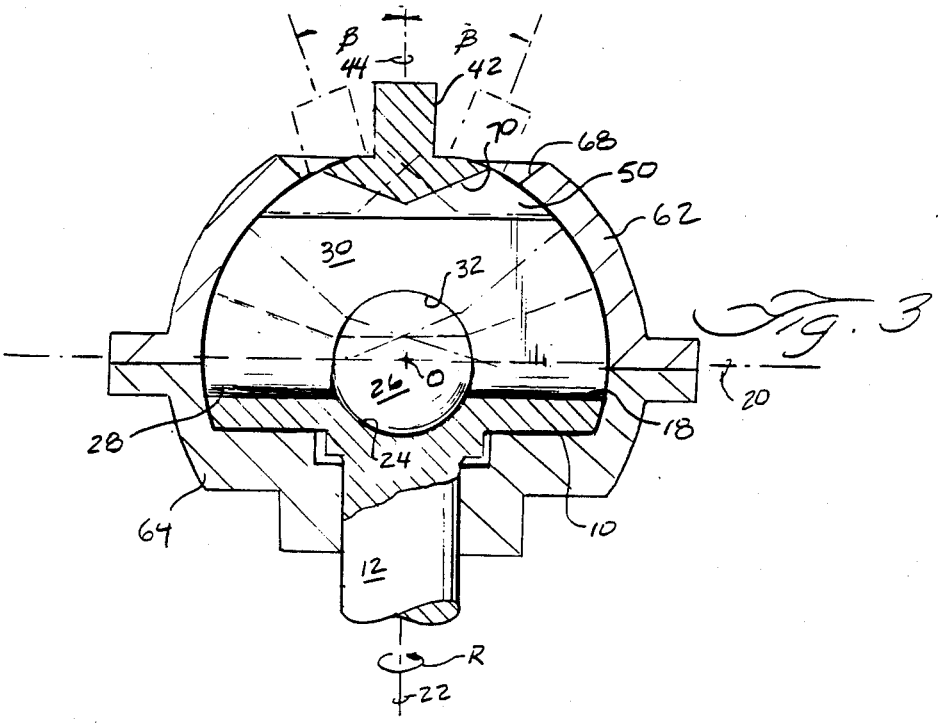
Fig. 3
Fig. 4
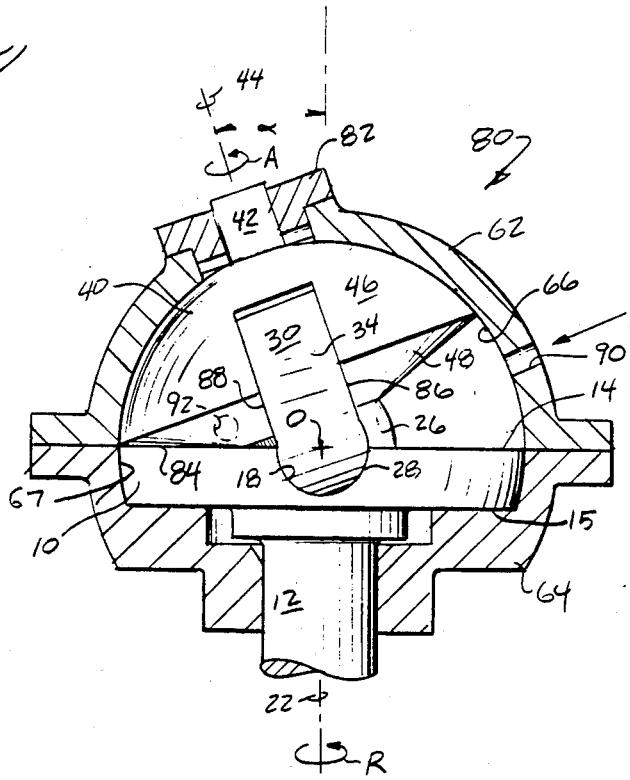

UNIVERSALLY-MOVABLE MACHINE PART AND FLUID TRANSFER APPARATUS UTILIZING SAME

INFORMATION DISCLOSURE

This application is based upon Venezuelan application Ser. No. 000,685 filed Apr. 30, 1984.

BACKGROUND AND SUMMARY OF THE INVENTION

The present invention relates to machine parts in general and, more specifically, to a machine part permitting universal freedoms of movement of a pair of oppositely-projecting shafts so as to permit for angular misalignment of the shafts.

The universally-movable machine part of the present invention is so designed that it is possible to adapt it to perform various functions either as an accessory element of a machine or as a primary working mechanism making up a machine system. Accordingly, in a specific embodiment of the present invention, the universally-movable machine part is included as a primary working mechanism in a fluid transfer apparatus for transferring a working fluid between inlets and outlets formed in a housing containing the machine part of the invention. The present invention thus finds utility as a hydraulic pump, a hydraulic motor, an air compressor, a cooling gas compressor, a pneumatic motor, a vacuum pump or as an internal combustion engine and the like.

In accordance with the present invention therefore, there is provided a universally-movable machine part having a disc member including a disc shaft which establishes a first rotational axis. The disc member also includes a recessed slot having a bearing surface conforming to a smooth cylindrically-curved plane such that the curved plane establishes a first center axis perpendicular to the first rotational axis of the disc shaft and intersecting the first rotational axis at a geometrical center point for the machine part.

At least one planar vane member having upper and lower end portions is provided in operative association with the disc member such that the lower end portion of the vane member defines a second bearing surface conforming to the smooth cylindrically-curved plane of the recessed slot formed in the disc. The second bearing surface thus mates with the bearing surface of the recessed slot so as to be pivotally slidably movable thereagainst such that the vane member is pivotal about the first center axis perpendicular to the first rotational axis of the disc shaft.

A rotor member, having an upper surface preferably in the form of a spherical cap, includes a rotor shaft. The rotor shaft thus establishes a second rotational axis intersecting the first rotational axis and the first center axis at the geometrical center point of the machine part. The rotor member also defines a groove which establishes a plane passing through the geometrical center point of the machine part and in which the upper portion of the vane member is accepted so as to permit the rotor shaft to be pivotally movable within the established plane about a second center axis intersecting the center point and being mutually perpendicular to both the first rotational and first center axes. The lower surface of the rotor member is in confronting relationship to the disc member such that the lower surface of the rotor member is upwardly and outwardly divergent relative to the center point. Preferably, the lower surface of the rotor member is an inverted conical surface and, due to its upward and outward divergent nature, permits the rotor member to be pivotally movable together with the vane member about the first center axis.

Thus, the rotor shaft is movable in a universal manner relative to the disc shaft due to the pivotal movements thereof permitted about the first and second center axes and due to the positive transfer of rotational movement from the disc shaft to the rotor shaft by virtue of the interconnection between the disc and rotor members provided by the vane member. In such a manner therefore, the rotor shaft will be angularly movable about the first rotational axis to thus form the generatrices of a conical surface having its apex located at the geometrical center point of the machine part.

Preferably, the disc member, vane member and rotor member are all contained within a housing having an opening defined therein which permits for the universal movement of the rotor shaft relative to the disc shaft. However, in a specific embodiment of the present invention, the housing mounts the disc and rotor shafts such that each extends outwardly from the housing to permit for rotational movement thereof in a predetermined rotational direction and such that the disc and rotor shafts are angularly oriented in a fixed-position relative to one another. In such a manner, the lower surface of the rotor member, by virtue of the angular orientation between the rotor and disc shafts, will contact an opposing surface of the disc so as to form a fluid seal line radially extending from the center point of the machine part. The end surfaces of the vane member, in turn, form respective end fluid seals with the interior housing surface. Accordingly, the vane member will establish a pair of fluid chambers with respect to portions of the lower rotor member surface, the disc surface and the interior housing surface such that the fluid chambers decrease in volume from the respective end fluid seals towards the radial fluid seal line. Thus, when a low pressure fluid, for example, is introduced into the larger portion of the fluid chamber and when the disc shaft is rotated, the fluid will be compressed towards the radial fluid seal line such that compressed fluid will exit the housing via an outlet located in close proximity to the radial seal line. In such a manner, the machine part of the present invention when incorporated as a constituent component in a housing will thus function as a fluid transfer apparatus.

Other advantages of the present invention will be gained after careful consideration is given to the detailed description of the preferred exemplary embodiments thereof which follow.

BRIEF DESCRIPTION OF THE ACCOMPANYING DRAWINGS

Reference will be hereinafter made to the accompanying drawings wherein like reference numerals throughout the various Figures denote like structural elements and wherein:

FIG. 3 is a cross-sectional elevational view taken along line 3—3 in FIG. 2;

FIG. 4 is an elevational view, partly in section, of a fluid transfer apparatus utilizing the device of FIG. 1.

DETAILED DESCRIPTION OF THE PREFERRED EXEMPLARY EMBODIMENTS

Figure 1:
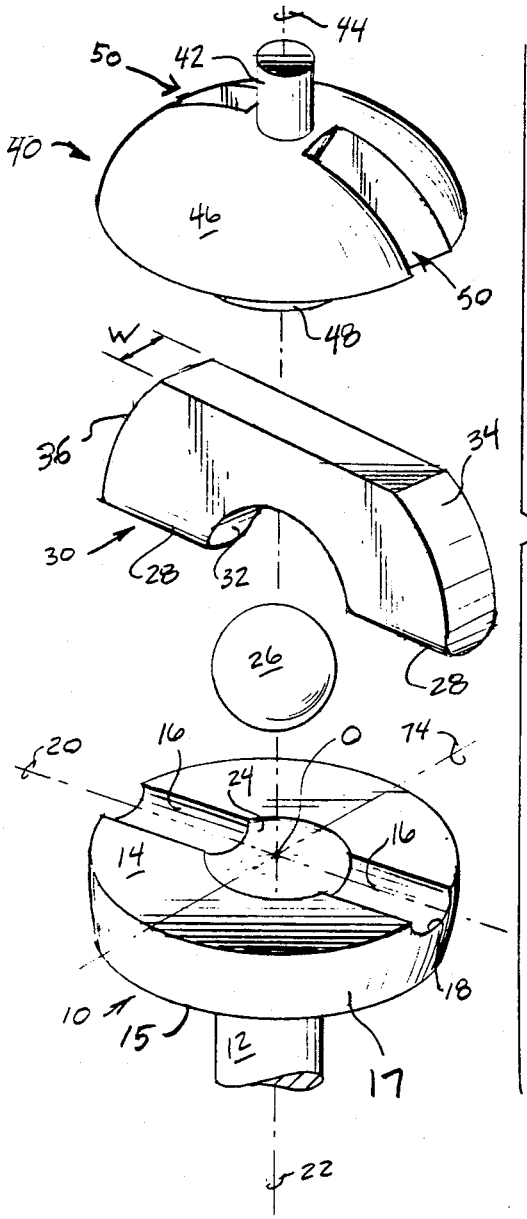
FIG. 1 is an exploded perspective view of the machine part in accordance with the present invention.

The component element of the machine part 1 of the present invention can be seen by reference to accompanying FIG. 1. As is evident, the machine part 1 includes a disc member 10 having a disc shaft 12 rigidly fixed thereto and outwardly projecting therefrom. The upper surface 14 is preferably planar in nature and includes an elongated slot 16 having a bearing surface 18 which conforms to a smooth cylindrically-curved plane. The bearing surface 18 of recessed slot 16 is thus curved about a first center axis 20 which intersects with the rotational axis 22 of disc shaft 12 at the geometric center point "0" of the machine part 1. The central portion of disc member 10 also defines a concave recess 24 so as to accept ball bearing 26 therein such that the spherical center of ball bearing 26 is coincident with the geometric center point "0" of the machine part 1.

A vane member 30 is provided with a lower end portion having a bearing surface 28 conforming to the smooth cylindrically-curved plane of the bearing surface 18. Accordingly, bearing surfaces 18 and 28 are pivotally slidably mated with one another so that the planar vane member 30 is pivotal about the first center axis 20. An arched surface 32 is centrally located relative the arcuate sides 34, 36, the former for conforming to the spherical shape of ball bearing 26 and thus permitting the vane member 30 to slidably traverse the exterior contact surface of ball bearing 26 while the latter conforms to the spherical interior surface 66 of upper partial housing 62 (see FIGS. 2 and 3). Likewise, the peripheral surface 17 of disc member 10 conforms to the spherical interior surface 67 of lower partial housing 64 to permit the former to slidably traverse the latter (see FIGS. 2 and 3). Peripheral surface 17 and arcuate sides 34, 36 conform to the same spherical shape in the preferred embodiment. The diameter of ball bearing 26 should be about two times greater than the cross-sectional width dimension "W" of vane member 30.

A rotor member 40 includes a rotor shaft 42 which establishes a rotor rotational axis 44, the rotor shaft 42 outwardly projecting in a direction generally opposite to disc shaft 12. The upper surface 46 of the rotor member 40 is preferably convex and spherical while the lower surface 48 is upwardly and outwardly divergent from the geometric center point "0" of the device. Preferably, lower surface 48 defines an inverted conically-shaped surface having its apex located at the center point "0". A recessed groove 50 establishes a plane which passes through the geometrical center point "0" and accepts the upper portion of vane member 30 therein.

Figure 2:
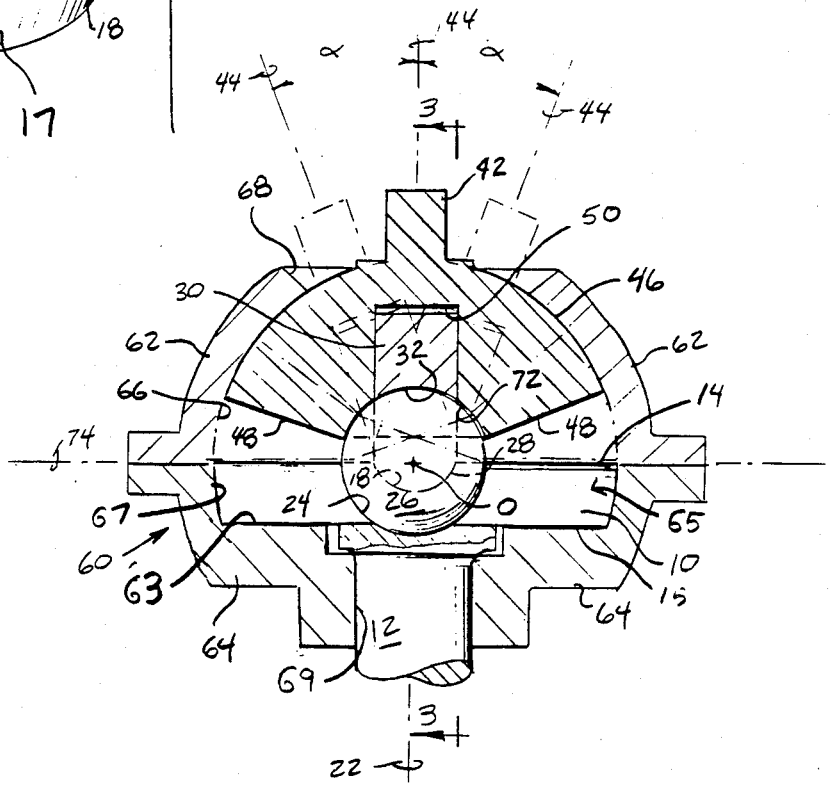
FIG. 2 is a cross-sectional elevational view of the machine part of the present invention.

The machine part 1 having the above-described structure is preferably placed in a housing 60 so as to retain the disc member 10, ball bearing 26, vane member 30 and rotor member 40 therein as is seen by reference to FIGS. 2–3. Housing 60 is preferably formed by upper and lower partial housings 62, 64. The lower partial housing 64 preferably defines a recess 65 bounded by spherical interior surface 67 so as to accept therein the disc member 10 such that the upper disc surface 14 lies within a plane passing through the geometric center point "0" of the device 1. The upper housing 62 on the other hand preferably defines an interior (concave) spherically-shaped surface 66 which permits the upper rotor surface 46 to be in sliding contact therewith. In effect, upper surface 46 of rotor member 40 and interior surface 66 function as a mating journal and bearing, wherein upper surface 46 of the rotor member is maintained in sliding contact with the interior surface. An upper opening 68 is provided in upper partial housing 62 so as to permit the rotor shaft 42 to be universally moved relative to disc shaft 12 as will be described in greater detail below.

Disc shaft 12 passes through a lower opening 69 defined through lower partial housing 64. In the preferred embodiment, disc shaft 12 is in close sliding contact with a cylindrical lower opening 69 and thus may not deviate from a position substantially axial to the lower opening. Axial movement of disc member 10 (and hence also disc shaft 12) is restricted in the preferred embodiment because a bottom surface 15 of the disc member abuts (and is in sliding contact with) a planar interior surface 63 of lower partial housing 64.

As can be seen in FIG. 2, the ball bearing 26 is seated within recess 24 so that its center point coincides with the geometric center point "0" of machine part 1. The arched surface 32 of vane member 30 thus translates over the spherical surface of ball bearing 26 concurrently with pivotal movement of vane member 30 about the first rotational axis 20 (i.e., about the axis extending perpendicularly from the plane of FIG. 2 passing through the geometric center point "0") due to the pivotal sliding contact between the cylindrically-curved vane bearing surface 28 and the conforming cylindrically-curved disc bearing surface 18. Since the lower surface 48 of rotor member 40 is outwardly and upwardly divergent from the geometric center point "0", the shaft 12 will be responsively pivoted about the first pivotal axis 20 so as to be pivotal through an angle $\alpha$ so that the rotor rotational axis 44 is displaced to angularly-oriented lateral positions relative to an aligned position with disc rotational axis 22 as can be seen in dashed line in FIG. 2. The degree of pivotal movement of rotor member 40 about the first center axis 20 is limited by the angle which lower surface 48 forms in cross-section with the plane, of upper disc surface 14. Accordingly, angle $\alpha$ will be equivalent to the angle which lower surface 48 forms in cross-section with upper disc surface 14 at the center point "0".

FIG. 3 shows another freedom of movement which rotor member 40 exhibits with respect to disc member 10. As can be seen, FIG. 3 is similar to FIG. 2 described above with the primary exception that the slot 50 is shown as extending parallel to the plane of FIG. 3. Slot 50 at its upper end portion terminates in a generally V-shaped surface 70 while the lower surface 48 of rotor member 40 establishes a spherically concave recess 72 (see FIG. 2) for bearing contact with the spherical surface of bearing 26. The slot 50 accepts the upper portion of vane member 30 and, by virtue of the bearing contact between the recessed surface 72 of rotor member 40 and the spherical surface of bearing 26, permits movements of rotor shaft 42 (and thus rotor rotational axis 44) within the plane defined by vane member 30 through an angle $\beta$ between forward and rearward positions noted in dashed line in FIG. 3. In this regard, pivotal movement of rotor member 40 between its forward and rearward positions noted in FIG. 3 is accomplished about a second center axis 74 (see FIGS. 1 and 2) which intersects the disc rotational axis 22 and first center axis 20 at the geometric center point "0" so as to be mutually perpendicular relative thereto.

Preferably, the V-shaped upper surface 70 of slot 50 forms an angle relative to horizontal at least equivalent to the angle formed in cross-section between the lower surface 48 of rotor member 40 and the planar disc surface 14.

As can be appreciated from the above discussion, when rotational movement of, e.g., shaft 12 occurs (noted by arrow R in FIG. 3) disc 10 will transmit such rotational movement to the vane member 30 by virtue of the latter's interengagement with slot 16. The vane member 30, in turn, transfers the rotational movement of shaft 12 in the direction R to the rotor shaft 42. During rotation of, e.g., disc shaft 12 in the direction of arrow R, the rotor shaft 42 will be permitted to assume various angular orientations relative to disc shaft 12 by virtue of the above structure which mounts the rotor member 40 for pivotal movements about the first and second center axes 20, 74, respectively. As such, the disc and rotor shafts 12, 42, respectively, are universally movable relative to one another and rotational movement of one of the disc and rotor shafts 12, 42, respectively, in a rotational direction (noted by arrow R in FIG. 3) is responsively transferred to the other of the disc and rotor shafts 12, 42, respectively.

Although ball bearing 26 has been described as having sliding contact with both arched surface 32 and concave recess 24, the ball bearing can be an integral part of either of disc member 10 or vane member 30. For example, ball bearing 26 may be integrally attached to arched surface 32 (by conventional means) to facilitate assembly or for other reasons.

Figure 5:
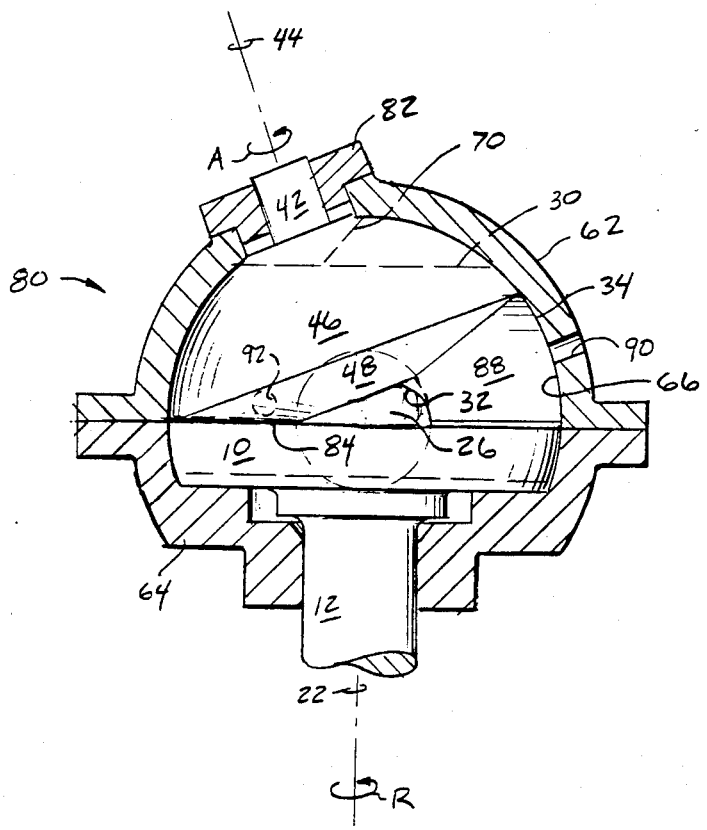
FIG. 5 is an elevational view, partly in section, of the apparatus shown in FIG. 4 with the device of FIG. 1 being rotated through an angle of 90°.

FIGS. 4 and 5 show a fluid transfer apparatus 80 in which the disc member 10, ball bearing 26, vane member 30 and rotor member 40 of machine part 1 are utilized. In the fluid transfer apparatus 80 of FIGS. 4 and 5, the disc shaft 12 is journally mounted to lower partial housing 64 for rotational movement about disc rotation axis 22 (noted by arrow R in FIG. 4) while rotor shaft 42 is journally coupled to upper partial housing 62 by means of journal sleeve 82. Journal sleeve 82 thus permits rotational movement of shaft 44 in the same direction (arrow A) as the rotational direction (arrow R) of disc shaft 12 but angularly orients shaft 42 so that rotor rotational axis 44 forms an angle $\alpha$ relative to disc rotational axis 22. Angle $\alpha$ is also equivalent to the angle formed between the lower surface 48 in cross-section and the planar surface 14 of disc 10 at the geometric center point "0". Thus, the lower surface 48 contacts the planar surface 14 of disc member 10 along a radial line 84 to provide a mechanical fluid seal therealong.

Because peripheral surface 17 of disc member 10 is spherical in shape and closely conforms to spherical interior surface 67 of lower partial housing 64, the peripheral surface and the interior surface 67 are in grazing contact with one another to establish a mechanical fluid seal therebetween. Similarly, since the lateral sides 34, 36 of vane member 30 are arcurately formed so as to be in grazing contact with the inner spherical surface 66 of upper partial housing 62, similar mechanical fluid seals will be formed therebetween. Moreover, in the preferred embodiment, a mechanical fluid seal is formed where arched surface 32 of vane member 30 contacts ball bearing 26 and where concave recess 24 contacts the ball bearing. As such, the opposing faces 86, 88 (see FIG. 4) of vane member 30 will establish a pair of fluid chambers each of which decreases in volume towards the radial fluid seal line 84 when the vane member 30 is disposed in the position shown in FIG. 5. Accordingly, when, for example, disc shaft 12 is rotated through an angle of 180° in the direction noted by arrow R from an initial position shown in FIG. 4, the volume of the fluid chamber defined on side 86 of vane member 30 decreases in volume while the volume of the fluid chamber defined on side 88 of the vane member increases in volume.

When low pressure fluid, for example, is introduced into the volumetrically larger one of the chambers through inlet 90 by suitable timing and control means (not shown) when the vane member 30 is in the position shown in FIG. 5, rotational movement applied to disc shaft 12 will thus cause the volume of the larger chamber to be reduced as the seals formed between the lateral edges 34, 36 of vane member 30 defining the chamber relatively approach the radial seal line 84 so as to compress the fluid within the chamber prior to its exhaust from the housing 60 through outlet 92.

In the embodiment of FIGS. 4 and 5, the structure of the present invention was described as functioning as a fluid compressor so as to transfer the fluid from an inlet 90 to an outlet 92. However, the structure could just as easily function as a hydraulic motor, for example, if high pressure fluid were injected into the outlet 92 and exhausted through the inlet 90 in an opposite manner described above. Accordingly, with the proper selection of timing and control means (not shown) which are believed well known to those skilled in this art, the present invention can be used in several beneficial ways to transfer fluids.

Accordingly, while the present invention has been herein described in what is presently conceived to be the most preferred and exemplary embodiments thereof, those in this art may recognize that many modifications may be made hereof which modifications shall be accorded the broadest scope of the appended claims so as to encompass all equivalent structures, devices and assemblies.

What is claimed is:

1. A universally-movable machine part comprising:

a disc member including a disc shaft establishing a first rotational axis, said disc member also including means defining a recessed slot having a first bearing surface conforming to a smooth cylindrically-curved plane, said curved plane establishing a first center axis perpendicular to said first rotational axis and intersecting said first rotational axis at a center point;

at least one planar vane member having upper and lower end portions, said lower end portion having a second bearing surface conforming to said smooth cylindrically-curved plane of said first bearing surface and pivotally slidably mated therewith so that said at least one planar vane member is pivotal between right and left lateral positions about said first center axis; and a rotor member including a rotor shaft which establishes a second rotational axis intersecting said first rotational and said first center axes at said center point, said rotor member also including (i) means defining a groove which establishes a plane passing through said center point and in which said upper portion of said at least one vane member is accepted for permitting said rotor shaft to be pivotally movable within said established plane between forward and rearward positions about a second center axis intersecting said center point and being mutually perpendicular to both said first rotational and said first center axes, (ii) a convex upper spherical surface from which said rotor shaft upwardly extends, and (iii) means defining a lower surface which extends continuously away from said groove means and is as well upwardly and outwardly divergent relative to said center point for permitting said rotor member to be pivotally movable together with said at least one vane member about said first center axis between right and left lateral positions, wherein said disc shaft and said rotor shaft are universally movable relative to one another and wherein rotational movement of one of said disc and rotor shafts in a predetermined rotational direction is responsively transferred to the other of said disc and rotor shafts.

2. A universally-movable machine part as in claim 1 wherein said lower surface defining means defines an inverted conical surface for establishing a limit of pivotal movement of said rotor member between said right and left lateral positions and between said forward and rearward positions by virtue of said inverted conical surface coming into bearing contact with said disc member.

3. A universally-movable machine part as in claim 1 further comprising housing means defining an interior space for housing said disc member, said at least one vane member and said rotor member.

4. A universally-movable machine part as in claim 3 wherein said housing means defines a first opening through which said rotor shaft projects for permitting universal movement of said rotor shaft between said forward, rearward, right lateral and left lateral positions relative said disc shaft and a second opening through which said disc shaft extends.

5. A unverisally-movable machine part as in claim 3 wherein:

said housing means includes means defining a concave spherical interior surface bounding said interior space; and wherein said convex upper spherical surface is in sliding contact with said concave spherical surface of said housing means.

6. A universally-movable machine part as in claim 1 further comprising ball bearing means having its spherical center coincident with said center point for providing a spherical contact surface against which said rotor member bears.

7. A universally-movable machine part as in claim 6 wherein said ball bearing means comprises a spherical bearing element integral to one of said rotor member and said disc member.

8. A universally-movable machine part as in claim 6 wherein said ball bearing means is a spherical bearing element and wherein said rotor member and said disc member together define a pair of opposing spherically-concave surfaces for retaining said bearing element therebetween.

9. A universally-movable machine part as in claim 8 wherein the diameter of said bearing member is greater than the cross-sectional thickness of said at least one vane member.

10. A universally-movable machine part as in claim 6, 8 or 9 wherein said at least one vane member includes means defining an arched surface for permitting said at least one vane member to slidably traverse said spherical contact surface upon pivotal movement thereof about said first center axis.

11. A fluid transfer apparatus comprising:

a disc member including a disc shaft establishing a first rotational axis, said disc member including means defining an upper disc surface and a recessed slot having a first bearing surface conforming to a smooth cylindrically-curved plane, said curved plane establishing a first center axis perpendicular to said first rotational axis at a center point;

at least one planar vane member having opposing planar side surfaces and upper and lower end portions and lateral end surfaces, said lower end portion having a second bearing surface conforming to said smooth cylindrically-curved plane of said first bearing surface and pivotally slidably mated therewith so that said at least one planar vane member is pivotal about said first center axis;

a rotor member including a rotor shaft which establishes a second rotational axis intersecting said first rotational and said first center axes at said center point, said rotor member including (i) means defining a groove which establishes a plane passing through the center point and in which said upper portion of said at least one vane member is accepted for permitting said rotor member to be pivotally movable within said established plane relative to said at least one vane member about a second center axis intersecting said center point and being mutually perpendicular to both said first rotational and said first center axes, (ii) a convex upper spherical surface from which said rotor shaft upwardly extends, and (iii) means defining a lower surface which extends continuously away from said groove means and is as well upwardly and outwardly divergent relative to said center point; and housing means defining an interior housing surface and having means defining first and second openings for introducing and discharging fluid relative to the interior of said housing means in response to the operation of said apparatus, said housing means for housing said disc member, said at least one planar vane member and said rotor member therein, said housing means including means for journally mounting disc and rotor shafts so that said disc and rotor shafts extend outwardly of said housing and to allow for rotational movements about said respective first and second rotational axes and for fixedly angularly orienting said rotor shaft relative said disc shaft, wherein said lower surface, by virtue of said angular orientation, lies in contact with said upper disc surface so as to form a fluid seal extending radially outwardly from said center point to said housing means in the direction of said angular orientation and wherein said lateral end surfaces of said vane members form respective end fluid seals with said interior housing surface, said opposing side surfaces of said at least one planar vane member establishing together with respective portions of said lower surface, said upper disc surface and said interior housing surface a pair of fluid chambers such that each of said fluid chambers change in volume between said respective end fluid seals and said radially extending fluid seal to thereby effect transfer of fluid between said first and second opening means upon rotation of said disc and rotor shafts.

12. A fluid transfer apparatus as in claim 11 wherein:

said housing means includes means defining a concave spherical portion of said interior housing surface; and said convex upper spherical surface is in sliding contact with said concave spherical portion.

13. A fluid transfer apparatus as in claim 11 further comprising ball bearing means having its spherical center coincident with said center point for providing a spherical contact surface against which said rotor member bears.

14. A fluid transfer apparatus as in claim 13 wherein said ball bearing means is a spherical bearing element and wherein said rotor member and said disc member together defined a pair of opposing spherically-concave surfaces for retaining said bearing element therebetween.

15. A fluid transfer apparatus as in claim 13 wherein said ball bearing means comprises a spherical bearing element integral to one of said rotor member and said disc member.

16. A fluid transfer apparatus as in claim 13 wherein said lower surface defining means defines an inverted conical surface to establish said radially extending fluid seal line.

17. A fluid transfer apparatus as in claim 13 wherein the diameter of said bearing member is greater than the cross-sectional thickness of said at least one vane member.

18. A fluid transfer apparatus as in claim 13, 14, or 17 wherein said at least one vane member includes means defining an arched surface for permitting said at least one vane member to slidably traverse said spherical contact surface upon pivotal movement thereof about said first center axis.

* * * * *